US006427297B1

(12) United States Patent
Yamaguchi et al.

(10) Patent No.: US 6,427,297 B1
(45) Date of Patent: Aug. 6, 2002

(54) BUCKLE WITH SMOOTH TONGUE INSERTION MECHANISM

(75) Inventors: Yutaka Yamaguchi; Akihiro Shiota; Yoshihiko Kawai; Tadayuki Asako; Takaaki Kimura, all of Tokyo (JP)

(73) Assignee: Takata Corporation., Tokyo (JP)

( * ) Notice: Subject to any disclaimer, the term of this patent is extended or adjusted under 35 U.S.C. 154(b) by 0 days.

(21) Appl. No.: 09/655,447

(22) Filed: Sep. 5, 2000

(30) Foreign Application Priority Data

Sep. 14, 1999 (JP) ..... 11-260685

(51) Int. Cl.[7] ..... A44B 11/25

(52) U.S. Cl. ..... 24/641; 24/633; 24/640; 24/636

(58) Field of Search ..... 24/633, 636, 637, 24/640, 641

(56) References Cited

U.S. PATENT DOCUMENTS

| | | | | | |
|---|---|---|---|---|---|
| 4,451,958 | A | * | 6/1984 | Robben et al. | 24/641 |
| 4,624,034 | A | | 11/1986 | Ishiguro et al. | |
| 5,121,528 | A | * | 6/1992 | Tanaka | 24/641 |
| 5,271,129 | A | * | 12/1993 | Clarke et al. | 24/641 |
| 5,357,658 | A | * | 10/1994 | Tanaka | 24/641 |
| 5,752,299 | A | * | 5/1998 | Vivacqua et al. | 24/633 |
| 5,870,810 | A | * | 2/1999 | Harrison et al. | 24/641 |
| 6,000,110 | A | * | 12/1999 | Wier | 24/633 |
| 6,170,134 | B1 | * | 1/2001 | Downie et al. | 24/641 |
| 6,233,794 | B1 | * | 5/2001 | Kohlndorfer et al. | 24/641 |
| 6,292,988 | B1 | * | 9/2001 | Jackson et al. | 24/641 |

FOREIGN PATENT DOCUMENTS

| | | | |
|---|---|---|---|
| DE | 29 03 230 | | 7/1980 |
| JP | 403277301 | A * | 12/1991 |
| JP | 405056805 | A * | 3/1993 |
| JP | 405278564 | A * | 10/1993 |

* cited by examiner

*Primary Examiner*—Anthony Knight
*Assistant Examiner*—Ruth C. Rodriguez
(74) *Attorney, Agent, or Firm*—Kanesaka & Takeuchi

(57) ABSTRACT

A buckle is formed of a base having two side walls, a cover for accommodating and supporting the base, and having a tongue insertion hole formed at one end side of the two side walls of the base, and guide portions provided on each of the two side walls to protrude inwardly therefrom for leading a tongue to be inserted through the tongue insertion hole. The guide portions lead a tip of the tongue smoothly without blocking even when the tongue is inserted from the tongue insertion hole at a maximum slant posture defined by the tongue insertion hole relative to the buckle. The tongue can be smoothly inserted into the buckle to improve the manipulation feeling in inserting the tongue.

4 Claims, 7 Drawing Sheets

BUCKLE WITH SMOOTH TONGUE INSERTION MECHANISM

BACKGROUND OF THE INVENTION AND RELATED ART STATEMENT

The present invention relates to a buckles for use in safety belt device, such as seat belt device, mounted on a seat of a vehicle, such as automobile.

Recently, on the seats of various types of vehicles, typically automobiles, seat belt devices are mounted to protect the vehicle occupants in case of emergencies, such as collisions. In order to readily fasten and unfasten the seat belt device of this type, normally there is provided a buckle which includes a latch member having a joggle unit for latching a tongue, the latch member being biased by a spring in a direction which allows latching of the tongue.

When the tongue is inserted from a tongue insertion hole of the buckle, the tip of the tongue is led inside by guide units provided on two side walls of a base of the buckle.

FIG. 7 is a schematic view of a conventional guide unit.

As shown in FIG. 7, on two side walls 71*a* of a base 71, guide units 72 are formed to protrude inward. As for each guide unit 72, the guide unit 72 leads the tip of a tongue 73 when the tongue 73 is inserted.

However, in this conventional buckle, the guide unit 72 is formed to be relatively short in the longitudinal direction. Thus, as shown by a two-dot chain line in FIG. 7, when the tongue 73 is inserted in a highly slanted manner relative to the buckle, the tip of the tongue 73 is sometimes caught on the edges of the guide units 72 to prevent a smooth insertion. Consequently, in the conventional buckle, the manipulation feeling for inserting the tongue 73 was not always satisfactory.

The present invention has been made in view of the problems, and an object of the invention is to provide a buckle which allows a smoother insertion of the tongue so that the manipulation feeling for insertion is significantly improved.

SUMMARY OF THE INVENTION

In order to solve the above-described problems, a buckle in a first aspect according to the present invention includes a base having two side walls, a cover for accommodating and supporting the base, and a tongue insertion hole formed in the cover at one end side of the two side walls of the base. The buckle includes guide portions for leading a tongue inserted through the tongue insertion hole, provided on each of the two side walls so as to protrude inward relative to the two side walls. The guide portion leads the tip of the tongue without abutting against the guide portion even when the tongue is inserted from the tongue insertion hole in the maximally slanted manner defined by the tongue insertion hole relative to the buckle.

In the invention according to a second aspect, the buckle further includes operation means for unlatching the tongue and the buckle. A part of the operation means overlaps a part of the guide portion in a longitudinal direction, and the part of the operation means leads the tip of the tongue to the guide portion when the tongue is inserted into the buckle from the tongue insertion hole.

As for the buckle according to the invention having the above-described construction, even when the tongue is inserted from the tongue insertion hole in a slanted manner relative to the longitudinal direction of the buckle, the tip of the tongue is prevented from abutting against the edges of the guide units and is securely led by the guide part to achieve the smooth insertion. The manipulation feeling for inserting the tongue is effectively improved since the vehicle occupant, when seated, is most likely to insert the tongue into the buckle in such a slanted manner.

Especially for the buckle according to the second aspect, because the part of the operation means overlaps the part of the guide portion in a longitudinal direction, the tip of the tongue is securely led by the two side walls serving as the operation means without abutting against the edge of the guide portion, further effectively improving the manipulation feeling for inserting the tongue.

BRIEF DESCRIPTION OF THE DRAWINGS

FIG. 6(*b*) illustrates a latched state where the tongue and the buckle are latched; FIG. 6(*c*) illustrates a state when the buckle is pulled back by a buckle pretensioner; and FIG. 6(*d*) illustrates a state when the buckle is pulled all the way back by the buckle pretensioner.

DETAILED DESCRIPTION OF PREFERRED EMBODIMENT

An embodiment of the present invention will be described below with reference to the drawings.

Figure 1:
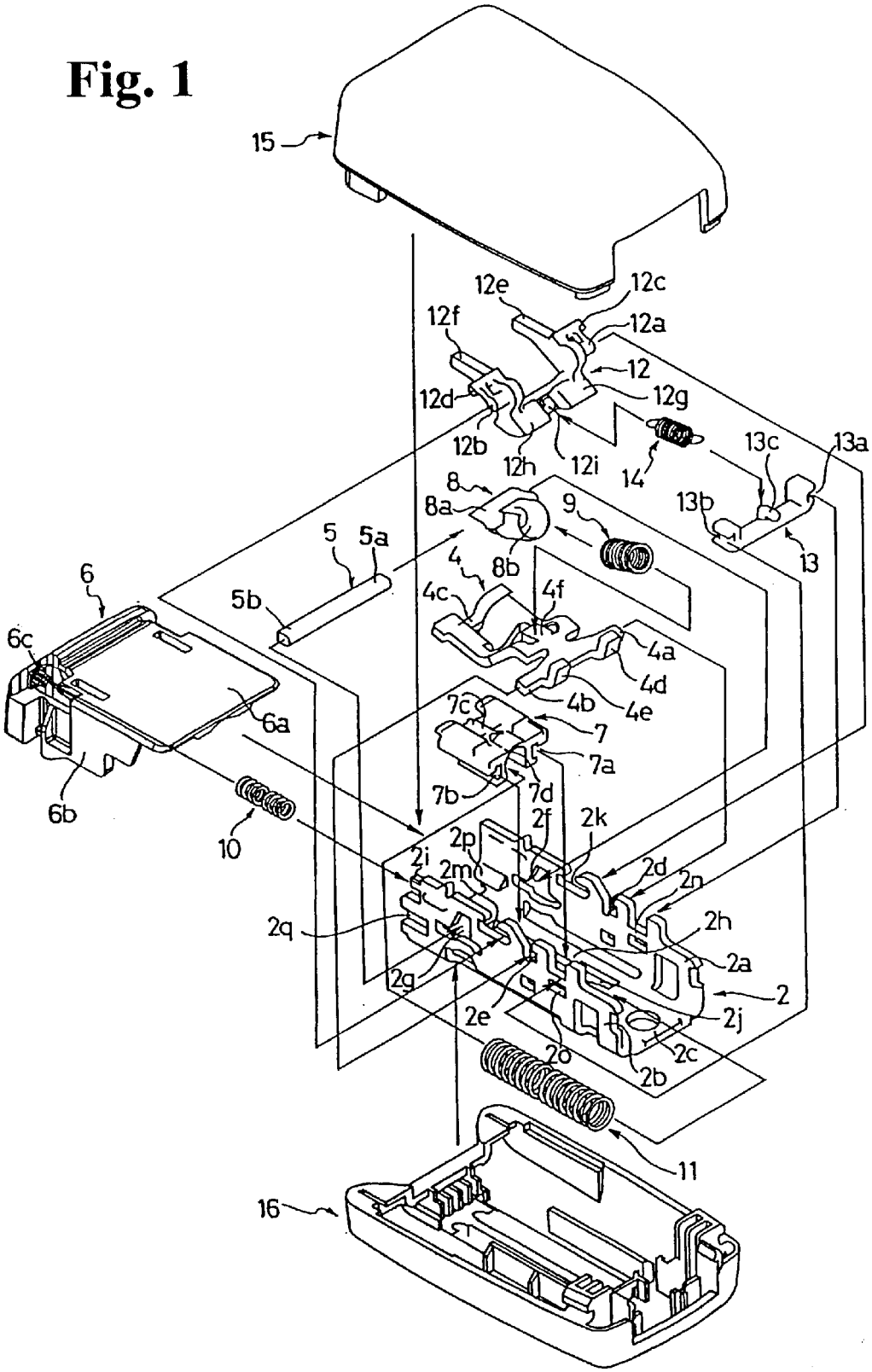
FIG. 1 is an assembly view of an embodiment of the buckle according to the present invention.
Figure 2:
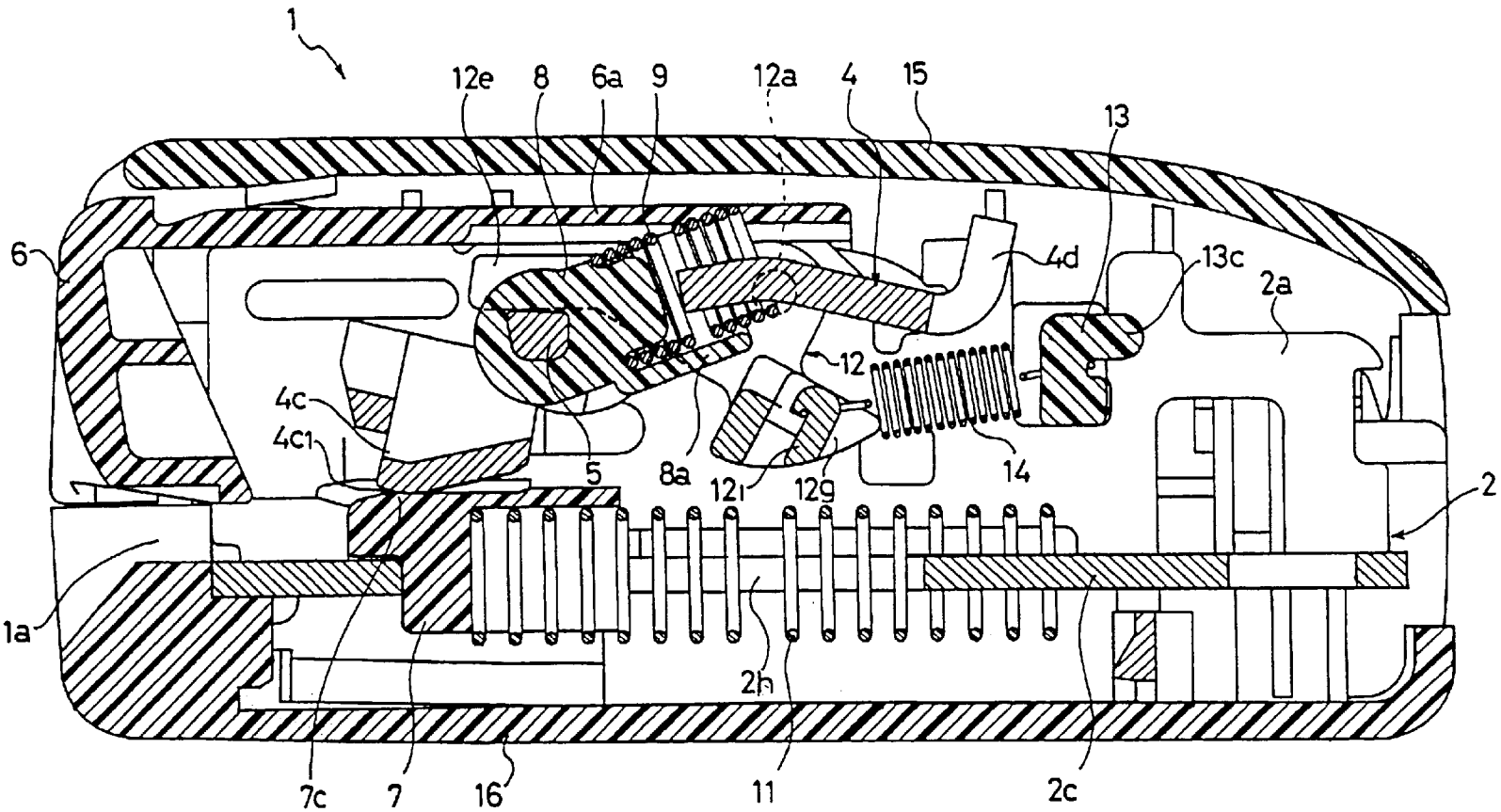
FIG. 2 is a cross sectional view of the embodiment when a tongue and the buckle are not latched.
Figure 3:
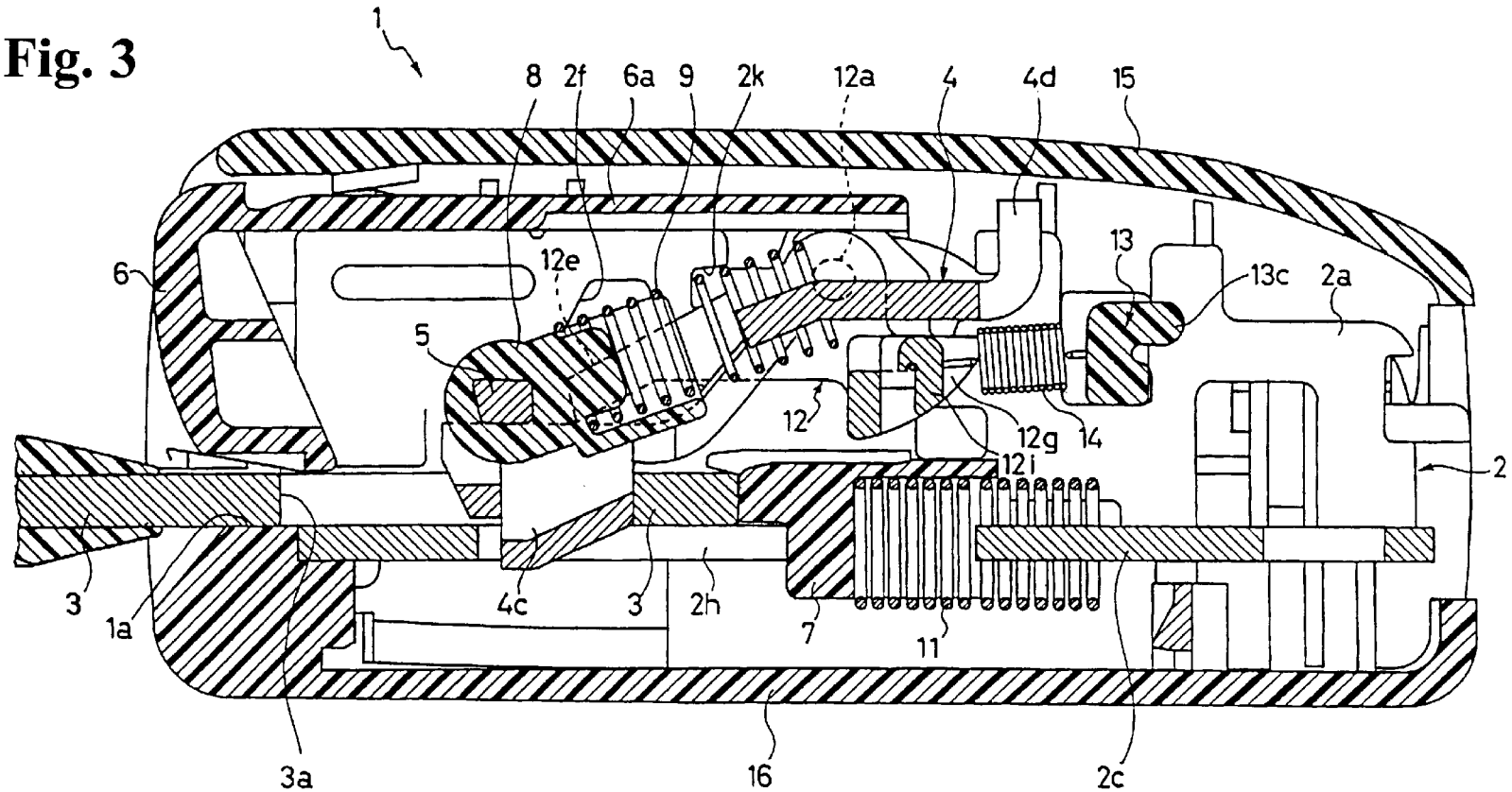
FIG. 3 is a cross sectional view of the embodiment when the tongue and the buckle are latched.
Figure 4:
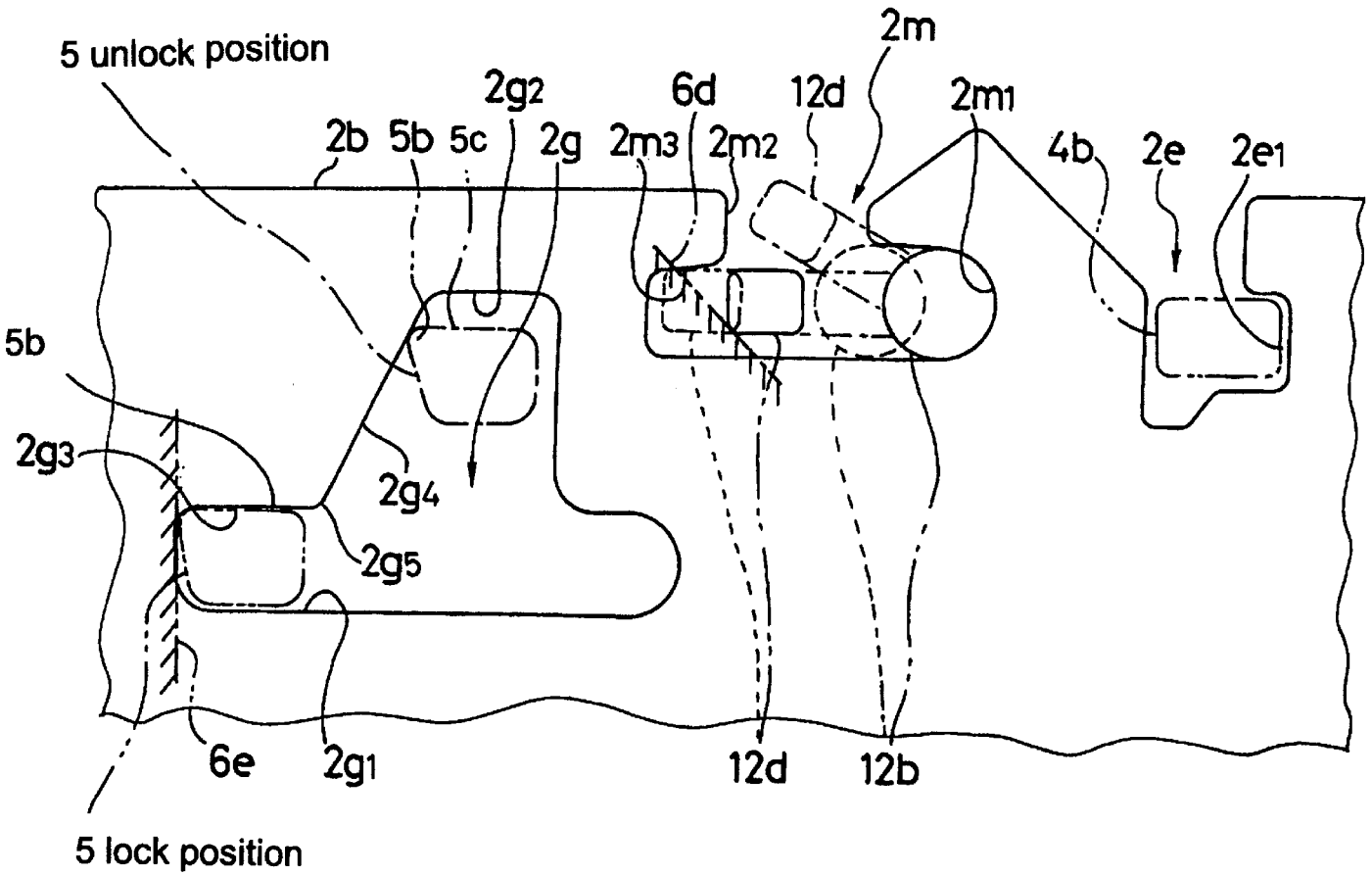
FIG. 4 illustrates a guide opening, a support and a guide groove provided in a side wall of a base of the embodiment.

FIG. 1 is an assembly view of a buckle according to an aspect of the present invention. FIG. 2 is a sectional view of the buckle of this embodiment when a tongue is not latched. FIG. 3 is a sectional view of the buckle of this embodiment when the tongue is latched. FIG. 4 illustrates a guide opening, a support and a guide groove disposed in a side wall of a base of this embodiment. The words "right" and "left" used in the description hereinafter indicate the right and left as viewed in the Figures.

As shown in FIGS. 1 to 4, a buckle 1 of this embodiment comprises a base 2 having a U-shaped frame with two side walls 2*a*, 2*b* and a bottom 2*c*; a latch member 4 which is pivotally supported by the side walls 2*a*, 2*b* of the base 2, for latching a tongue 3; a lock pin 5 movably disposed to the two side walls 2*a* and 2*b* of the base 2, for preventing the latch member 4 from moving in the direction which cancels the latching at the time the tongue 3 and the latch member 4 are latched; an operation button 6 which is disposed in the two side walls 2*a*, 2*b* of the base 2 and is capable of moving in the longitudinal direction; an ejector 7 which is provided in the bottom 2*c* of the base 2 so as to be movable in the longitudinal direction of the base 2 and which is capable of urging the tongue to be released from the buckle 1; a slider 8 having a lock pin retainer 8a for retaining the lock pin 5; a slider spring 9 compressed between the slider 8 and the latch member 4, which constantly urges the slider 8 so that the lock pin 5 is pushed toward the latch member 4; a button spring 10 for constantly urging the operation button 6; an ejector spring 11 for constantly urging the ejector 7; an inertia lever member 12 supported by the two side walls 2*a*, 2*b* of the base 2 as to be pivotable and movable in the longitudinal direction of the base 2, for preventing the lock pin 5 by inertia from moving toward a latch-release position when the tongue 3 and the latch member 4 are latched; a spring holder 13 fixed and supported by the two side walls 2*a*, 2*b* of the base 2; a lever spring 14 disposed to stretch between the inertia lever member 12 and the spring holder 13; and an upper cover 15 and a lower cover 16 which are constructed to engage each other in order to cover the base 2 on which these components are mounted, from the top and the bottom.

The two side walls 2*a*, 2*b* of the base 2 comprise, respectively, supports 2*d* and 2*e* for pivotally supporting pivot shafts 4*a* and 4*b* of the latch member 4; and convex-shaped guide openings 2*f* and 2*g* for supporting and guiding two end portions 5*a* and 5*b* of the lock pin 5. The base 2 includes guide rails 2*h* to which guide grooves 7*a* and 7*b* of the ejector 7 are slidably engaged in order to guide the ejector 7 in a longitudinal direction. The guide rails are disposed symmetrically about the longitudinal axis, but only one of them is shown in FIG. 1. The side wall 2*b* further comprises a spring support 2*i* for supporting one end of the button spring 10; and a spring support 2*j* for supporting one end of the ejector spring 11. The two walls 2*a* and 2*b* further include guide grooves 2*k* and 2*m* for accommodating urged parts 12*c* and 12*d* for bringing the inertia lever member 12 from the operating position to a non-operation position by the pressure from the operation button 6, attachments 2*n* and 2*o* to which attachments 13*a* and 13*b* of the spring holder 13 are detachably engaged, and guides 2*p* and 2*q* for leading the tongue 3 upon insertion of the tongue 3.

The support 2*e*, the convex-shaped guide opening 2*g* and the guide groove 2*m* formed in the side wall 2*b* are shaped as shown in FIG. 4. More specifically, the support 2*e* has a shaft support 2*e*1 for pivotally supporting the pivot shaft 4*b* of the latch member 4. The convex-shaped guide opening 2*g* comprises a longitudinal portion 2*g*1 extending in the longitudinal direction and a vertical portion 2*g*2 extending vertically from the middle portion of the longitudinal portion 2*g*1. In the upper portion of the left end of the longitudinal portion 2*g*1, there is a lock pin restraining portion 2*g*3 for restraining the lock pin 5 from the top to prevent an upward movement of the lock pin 5 when, as will be described later, the lock pin 5 is in a lock position (shown by the two-dot chain line in FIG. 4). In the left end of the vertical portion 2*g*2, there is a guide portion 2*g*4 for leading the lock pin 5 when the lock pin 5 is moved from an unlock position (shown by the one-dot chain line in FIG. 4) to the lock position or vice versa, as will be described later. The guide portion 2*g*4 is formed as an inclined surface which inclines rightward from the longitudinal portion 2*g*1. The portion that connects the lock pin restraining portion 2*g*3 and the guide portion 2*g*4 is referred to as an arc-shaped R portion 2*g*5. It is desirable that the radius of the R portion 2*g*5 is as small as possible.

The guide groove 2*m* comprises a pivot shaft support 2*m*1 for supporting a pivot shaft 12*b* of the inertia lever member 12; an opening portion 2*m*2 through which the urged portion 12*d* can pass as shown by one-dot chain line in FIG. 4 at the time the inertia lever member 12 is pivoted between a non-operation position to an operation position; and a pivot restraining portion 2*m*3 against which the urged portion 12*d* is abutted when the inertia lever member 12 performs an inertia movement as shown by a two-dot chain line in FIG. 4, for restraining the inertia lever member 12 from pivoting toward the non-operation position.

It is to be noted that, although not shown in FIG. 4, the support 2*d*, the guide opening 2*f* and the guide groove 2*k* formed in the side wall 2*a* are shaped to be identical with the support 2*e*, guide opening 2*g* and guide groove 2*m*, respectively. In the description hereinafter, reference numeral 2*f*1 denotes a longitudinal portion, 2*f*2 a vertical portion, 2*f*3 a lock pin restraining portion, 2*f*4 a guide portion, and 2*f*5 an R portion, though these reference numerals do not appear in the Figures.

Figure 5B:
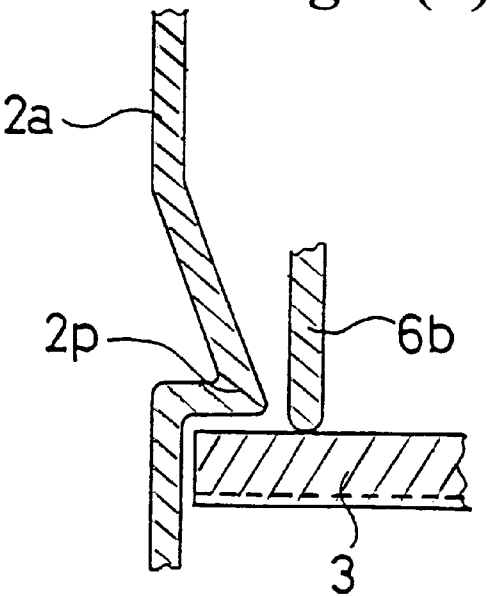
FIG. 5(*a*) is a partial diagrammatic sectional view of the buckle, taken in the longitudinal direction, when the tongue is being inserted, and FIG. 5(*b*) is a cross section of the same taken along line 5(*b*)—5(*b*) in FIG. 5(*a*)
Figure 5A:
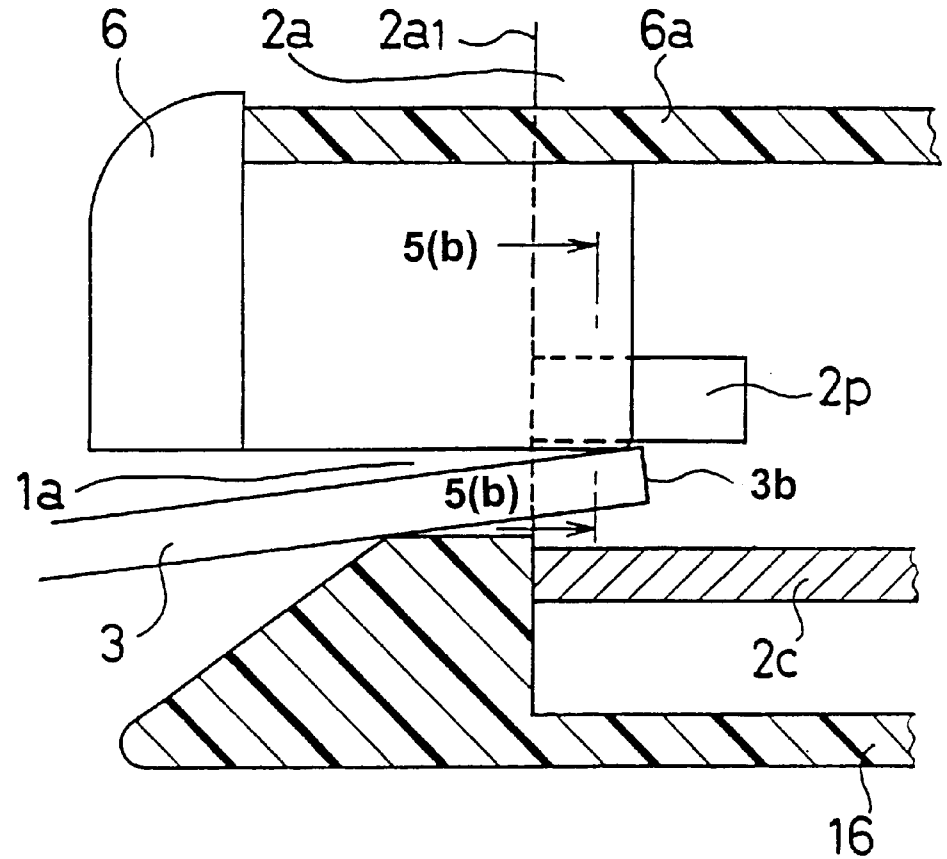

The guides 2*p* and 2*q* for guiding the tongue 3 upon insertion of the tongue 3 are formed as ribs extending in a longitudinal direction, these ribs constituting dowels made by denting the two side walls 2*a* and 2*b* inward so as to protrude inward from the two side walls 2*a* and 2*b*, respectively. As shown in FIG. 5(*a*), the guide 2*p* extends in the longitudinal direction from the left end 2*a*1 of the side wall 2*a* up to the conventional point to which the tip portion 3*b* of the tongue 3 inserted from the tongue insertion hole 1*a* of the buckle 1 in a slanted manner relative to the longitudinal direction of the buckle 1 makes contact. Although not shown in FIG. 5(*a*), the guide 2*q* is arranged on the side wall 2*b* in an identical manner.

Accordingly, by providing the guides 2*p* and 2*q*, the tip portion 3*b* of the tongue 3 is securely led by the guides 2*p* and 2*q* to achieve a smooth insertion even when the tongue 3 is inserted from the tongue insertion hole 1*a* in the most slanted manner relative to the longitudinal direction of the buckle 1 defined by the tongue insertion hole 1*a*. Because a vehicle occupant is likely to insert the tongue 3 into buckle 1 in such a slanted manner when the occupant is seated, the manipulation feeling for inserting the tongue 3 is effectively improved. Furthermore, the buckle 1 of this embodiment is provided with two side walls 6*b* of the operation button 6, right ends of the two side walls, as will be described later, extending up to the position which allows guiding of the tip 3*b* of the tongue 3 to the guides 2*p* and 2*q* upon insertion of the tongue 3. More particularly, parts of the two side walls 6*b* of the operation button 6 are arranged to overlap parts of the guides 2*p* and 2*q* in a longitudinal direction. In this manner, the tip portion 3*b* of the tongue 3 is securely led by the two side walls 6*b* of the operation button 6 up to the guides 2*p* and 2*q* without abutting against the guides 2*p* and 2*q*. Therefore, the manipulation feeling for inserting the tongue 3 is further effectively enhanced.

The latch member 4 includes a joggle portion 4*c* for latching the tongue 3; release force support portions 4*d* and 4*e* against which an end portion opposite to the operation-end of the operation button 6 abuts so that the latch member 4 is pushed in a latch-releasing direction when the tongue 3 and the buckle 1 are being unlatched by the operation button 6; and a spring support 4*f* for supporting one end of the slider spring 9. As for this latch member 4, a non-latch position is set where the tongue is not latched, and a latch position is set where the tongue 3 is latched. Meanwhile, the latch member 4 is made pivotable about the pivot shafts 4*a* and 4*b* between the non-latch position and the latch position.

The lock pin 5 has a lower end always contacting the upper surface of the latch member 4. The urging force of the slider spring 9 sets the lock pin 5 to be placed in the aforementioned lock position within the longitudinal portions 2f1 and 2g1 of the convex-shaped guide openings 2f and 2g, for locking the latched latch member 4 at the time the tongue 3 and the latch member 4 are latched. The release force of the operation button 6 sets the lock pin 5 to be placed in the aforementioned unlock position within the vertical portions 2f2 and 2g2 of the convex-shaped guide openings 2f and 2g, for releasing the latch member 4 from the tongue 3, which is located at the right of the above lock position. The lock pin 5 is so formed that its cross section has generally the shape of a rectangle or a trapezoid with a shorter lower side. Corner portions 5a, 5b of the lock pin 5 move while constantly contacting the guide portions 2f4 and 2g4 of the convex-shaped guide openings 2f and 2g, and the R portions 2f5 and 2g5, respectively. The upper surface 5c of the lock pin 5 moves while contacting the restraining portions 2f3 and 2g3. The corner portions 5a, 5b are R portions, and it is preferable that the radius of the R portions is made as small as possible.

The operation button 6 comprises a plate 6a which extends in the longitudinal direction and the crosswise direction; two side walls 6b formed by bending the plate 6a at two opposing sides of the plate 6a (although the other side wall formed similarly to that shown in FIG. 1 is not shown, for the purpose of explanation, reference numeral 6b represents both side walls); and spring support 6c arranged off the longitudinal center toward one side, for supporting the other end of the button spring 10. As the operation button 6 is provided with the plate 6a and two side walls 6b, a part of the operation button 6 has its cross section generally in the shape of a bracket as shown in FIGS. 2 and 3. However, as for the other part of the operation button 6, while the plate 6a is provided to extend over the right side of the pivot shafts 12a and 12b of the inertia lever member 12, two side walls 6b, as described above, are provided to extend only up to the position sufficient to lead the tip 3b of the tongue 3 to the guides 2p and 2q upon insertion of the tongue 3.

Although not shown in FIGS. 1 to 3, on the inner side of the two side walls 6b of the operation button 6, there are provided inertia lever member parts, each of which comprises an inclined surface (schematically illustrated in FIG. 4 as an inertia lever member part 6d), for pushing the urged portions 12c and 12d of the inertia lever member 12 in order to make the inertia lever member 12 pivot from the operation position to the non-operation position. Likewise, although not shown in FIGS. 1 to 3, on the inner side of the two side walls 6b of the operation button 6, there are provided lock pin parts, each of which includes a vertical surface (also schematically illustrated in FIG. 4 as a lock pin moving portion 6e), for pushing the ends of the lock pin 5 in order to move the lock pin 5 from the lock position to the unlock position.

In this embodiment, when the operation button 6 is moved to the right by the operation for releasing the latched tongue 3 and buckle 1, first, the inertia lever member moving portions 6d contact the urged portions 12c and 12d of the inertia lever member 12 to push the urged portions 12c and 12d up to the non-operation position of the inertia lever member 12, and then the lock pin parts 6e contact the lock pin 5 to move the lock pin 5 toward its unlock position.

The ejector 7 includes a rib 7c which is provided in its longitudinal center and which substantially makes point-contact when the bottom of the joggle portion 4c of the latch member 4 makes contact, and a spring support 7d for supporting the other end of the ejector spring 11.

The slider 8 includes a spring support 8b for supporting the other end of the slider spring 9.

The inertia lever member 12 constitutes a shockproof system which prevents the lock pin 5 and the operation button 6 from moving toward the latch-release position due to inertia when the tongue 3 and the buckle 1 are latched. The inertia lever member 12 comprises levers 12e and 12f, mass bodies 12g and 12h each having its center of gravity G located to be generally orthogonal to the levers 12e or 12f, and a spring support 12i for supporting one end of the lever spring 14. Here, masses of the mass bodies 12g and 12h are so set that the inertial moment about the pivot shafts 12a and 12b which acts on the center of gravity G of the mass bodies 12g and 12h due to inertia is greater than the moment about the pivot shafts 12a and 12b due to the force of the inertia lever member parts 6d pushing up the urged portions 12c and 12d of the inertia lever member 12 toward the non-operation position of the inertia lever member 12 at the time the operation button is moved to the latch-release direction.

The spring holder 13 includes a spring support 13c for supporting the other end of the lever spring 14.

Among the components described above, the operation button 6, the ejector 7, the slider 8, the spring holder 13, the upper cover 15, and the lower cover 16 are respectively made by resin and other remaining components are all made by metal.

Furthermore, to the base 2 of the buckle 1, a known buckle pretensioner, not shown in the figures, is connected. This buckle pretensioner rapidly pulls back the base 2 rightward at the time of emergency, such as vehicle collision, in order to quickly restrain the vehicle occupant with the seat belt.

Next, the operation for latching the tongue 3 and the buckle 1 having the above-described construction and the operation for preventing disengagement due to inertia utilizing the shockproof system comprising the inertia lever member 12 will be described.

Figure 6A:
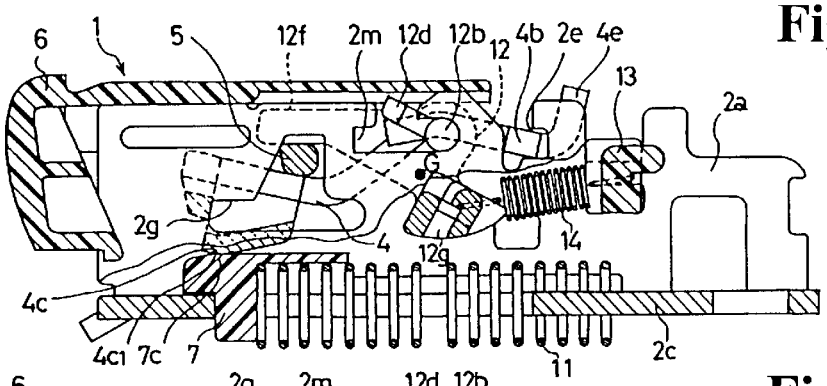
FIGS. 6(*a*) to 6(*d*) explain an operation for latching the buckle and the tongue, wherein FIG. 6(*a*) illustrates an unlatched state where the tongue is not latched.
Figure 6B:
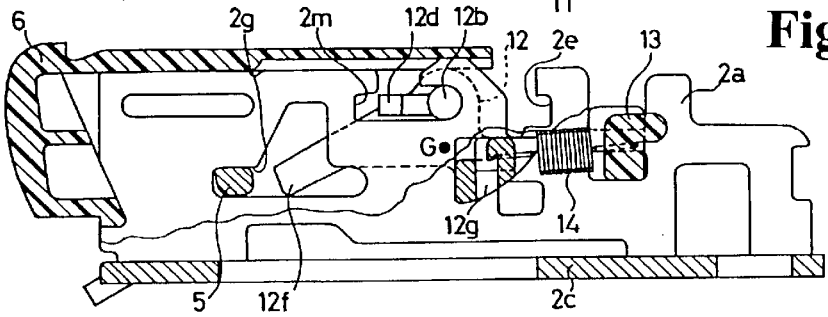
Figure 6C:
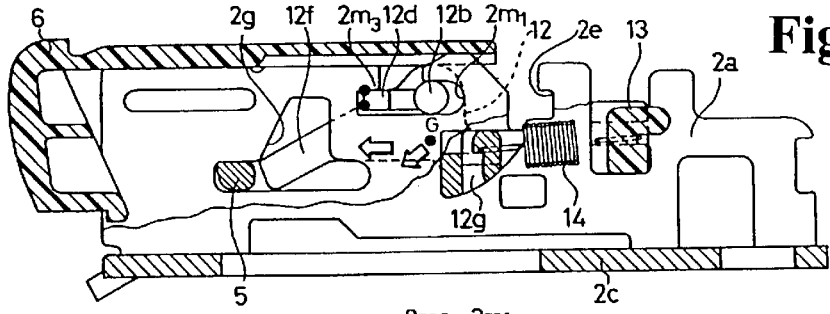
Figure 6D:
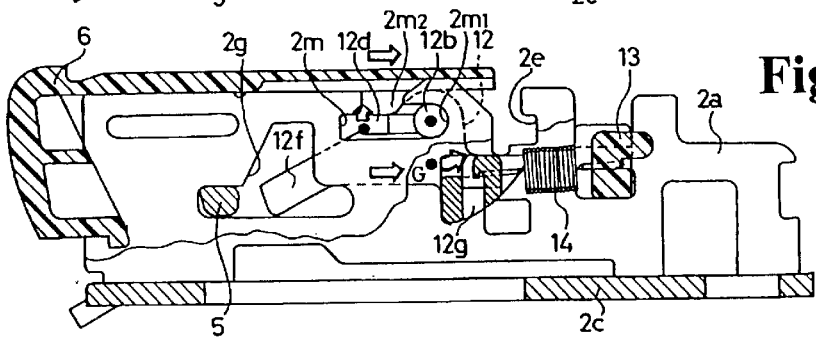
Figure 7:
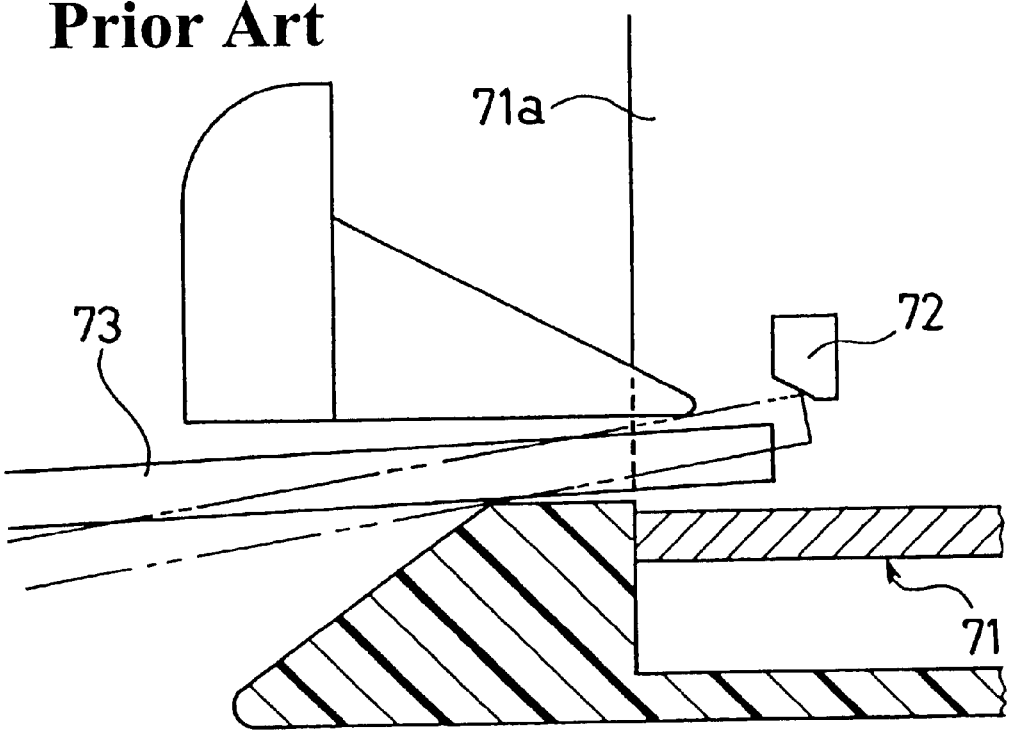
Fig. 7 Prior Art
FIG. 7 is a schematic view of a conventional guide unit which guides a tip of the tongue upon insertion of the tongue into the buckle.

FIGS. 6(a)–6(d) explain the operation for latching the buckle of this embodiment and the tongue, and the operation for preventing disengagement due to inertia while they are latched. FIG. 6(a) illustrates the buckle without the tongue being latched, FIG. 6(b) illustrates the buckle with the tongue being latched, FIG. 6(c) illustrates the buckle when it is pulled back by the buckle pretensioner, and FIG. 6(d) illustrates the buckle when it is pulled all the way back by the buckle pretensioner. It should be noted that, for the purpose of explaining the operation, cross sections in FIGS. 6(a)–6(d) are taken in an irregular manner and some of the components irrelevant to the description are omitted from the illustration.

When the tongue 3 is not latched to the buckle 1, as shown in FIGS. 2 and 6(a), the ejector 7 is set in its left-most position by the urging force of the ejector spring 11. As for the ejector 7 at the left-most position, the ejector 7 pushes up the joggle portion 4c of the latch member 4, so that the bottom portion 4c1 of the joggle portion 4c of the latch member 4 is on the top of the rib 7c of the upper surface of the ejector 7 to substantially make a point-contact. Here, the latch member 4 is off and out of the insertion path of the tongue 3 and is set to be in the non-latch position where the tongue 3 does not latch. Meanwhile, the lock pin 5 contacts the upper surface of the latch member 4, is pushed up by the latch member 4 and is set to be in the unlock position within the vertical portion 2f2 and 2g2 of the convex-shaped guide openings 2f and 2g. When the buckle 1 is not latched, the levers 12e and 12f of the inertia lever member 12 are placed on the top of the lock pin 5. Thus, by pushing up the lock pin 5 to the non-lock position, the levers 12e and 12f of the inertia lever member 12 are set in the non-operation position shown by a dotted line in FIG. 6(*a*). The pivot shafts 12*a* and 12*b* of the inertia lever member 12 contact the pivot shaft support 2*m*1 by being pulled rightward by the urging force of the lever spring 14.

The buckle 1 shown in FIGS. 2 and 6(*a*) is not yet latched. When the tongue 3 is inserted through the tongue insertion hole 1*a* provided at the left end portion of the buckle 1, the right end of the tongue 3 abuts against the left end of the ejector 7, and the ejector 7 is pressed rightward. As the ejector 7 moves rightward corresponding to the insertion of the tongue 3 while compressing the ejector spring 11, the joggle portion 4*c* of the latch member 4 disposed on the top of the rib 7*c* of the ejector 7 comes off from the ejector 7. Since the lock pin 5 is pressed downward via the slider 8 by the urging force of the slider spring 9 and this lock pin 5 is pushing the joggle portion 4*c* of the latch member 4, the latch member 4 pivots counterclockwise, as viewed in the figures, about the pivot shafts 4*a* and 4*b*. Consequently, the joggle portion 4*c* of the latch member 4 enters the moving path of the tongue 3 to engage a latch aperture 3*a* of the tongue 3 and the latch member 4 is set to be in the latch position. Once the force for inserting the tongue 3 is terminated, the ejector 7 pushes the right end of the tongue 3 by the urging force of the ejector spring 11 and the right end portion of the latch aperture 3*a* in the tongue 3 engages the joggle portion 4*c* to latch the tongue 3 with the buckle 1. Then, the tongue 3 and the buckle 1 are latched as shown in FIGS. 3 and 6(*b*).

At this stage, by the urging force of the slider spring 9, the lock pin 5 is led by the guide portion 2*g*4 including an inclined surface and is moved downward within the vertical portion 2*g*2. Then, the lock pin 5 enters the longitudinal portion 2*g*1 and moves leftward to be in the lock position. When the lock pin 5 is in the lock position, because the upper surface of the lock pin 5 is restrained from the top by the restraining portion 2*g*3, the lock pin 5 is restrained from moving upward. Accordingly, the lock pin retains the latch member 4 in the latch position so that the latch member 4 does not come off from the latch aperture 3*a* of the tongue 3 and that the tongue 3 and the buckle 1 are kept being latched tightly.

When the tongue 3 and the buckle 1 are latched, the inertia lever member 12 pivots counterclockwise about the pivot shafts 12*a* and 12*b* supported by the pivot shaft support 2*m*1 because the spring support 12*i* of the inertia lever member 12 is pulled by the urging force of the lever spring 14. Accordingly, as shown in FIG. 6(*b*), the tips of the levers 12*e* and 12*f* are placed on the moving path of the lock pin 5, the path leading to the unlock position while allowing the urged portions 12*c* and 12*d* to pass through the opening portions 2*k*2 and 2*m*2. The inertia lever member 12 is in the operation position. When the inertia lever member 12 is in the operation position, the lock pin 5 is restrained from moving toward the unlock position as the lock pin 5 trying to move toward the unlock position abuts against the levers 12*e* and 12*f*.

Thus, the tongue 3 is securely latched to the buckle 1, and the buckle 1 and the tongue 3 are securely prevented from disengaging.

When the operation button 6 is pushed rightward to unlatch the tongue 3 and the buckle 1, the operation button 6 moves toward the right and, as described before, the inertia lever member parts 6*d* push up the urged portions 12*c* and 12*d* of the inertia lever member 12 toward the operation position. Then, the inertia lever member 12 pivots clockwise about the pivot shafts 12*a* and 12*b* while the urged portions 12*c* and 12*d* pass through the opening portions 2*k*2 and 2*m*2. Accordingly, the tips of the levers 12*e* and 12*f* move up and out of the longitudinal path in which the lock pin 5 moves.

At this stage, when the operation button 6 is further moved to the right, the lock pin parts 6*e* move the lock pin 5 to the right. When the lock pin 5 reaches the position which allows the lock pin 5 to move toward the vertical portion 2*g*2, the restraining portion 2*g*3 is no longer capable of restraining the lock pin 5, allowing the latch member 4 to pivot clockwise about the pivot shafts 4*a* and 4*b*. Here, the lock pin 5 is located directly below the levers 12*e* and 12*f*. Because the lock pin 5 is no longer restrained by the restraining portion 2*g*3 and the ejector 7 is biased toward the latch-release direction by the urging force of the ejector spring 11, the ejector 7 pushes the latch member 4 upwardly so that the latch member 4 pivots clockwise about the pivot shafts 4*a* and 4*b*. The joggle portion 4*c* comes off from the latch aperture 3*a* of the tongue 3 while pushing out the tongue 3 leftward. At this stage, the lock pin 5 is pushed up by the latch member 4 as the latch member 4 pivots clockwise and enters the vertical portions 2*f* and 2*g*. Furthermore, the lock pin 5 pushes up the levers 12*e* and 12*f* so that the inertia lever member 12 pivots clockwise about the pivot shafts 12*a* and 12*b*.

The bottom 4cl of the joggle portion 4*c* of the latch member 4 is placed on the rib 7*c* of the ejector 7, and then finally, the ejector 7 is placed in its left-most position. The latch member 4 is placed in the non-latch position, the lock pin 5 is placed in the unlock position, and the inertia lever member 12 is placed in the non-operation position, so that the buckle 1 releases the tongue 3 so as to be in the state as illustrated in FIGS. 2 and 6(*a*).

Next, the operation of the shockproof system comprising the inertia lever member 12 is described.

When a belt is fastened, that is, when the buckle 1 and the tongue 3 are latched as shown in FIGS. 3 and 6(*b*) and the buckle pretensioner is operated during the emergency situation, such as vehicle collision, the base 2 is rapidly pulled back rightward. Accordingly, a significantly large acceleration in the rightward direction is exerted on the buckle 1, so that the buckle 1 receives a large inertial force in the leftward direction. At this time, the inertia lever member 12 is capable of moving leftward and pivoting clockwise. Thus, during the time the buckle 1 is being pulled back by the buckle pretensioner, only the inertia lever member 12 is moved leftward by the inertial force acting on its center of gravity G as shown in FIG. 6(*c*), and the urged portions 12*c* and 12*d* of the inertia lever member 12 immediately come to be placed beneath the pivot restraining portion 2*m*3. At this time, even though the inertia lever member 12 is urged to pivot clockwise by the inertial force acting on the center of gravity G of the mass bodies 12*g* and 12*h*, the tips of the urged portions 12*c* and 12*d* abut against the pivot restraining portion 2*m*3 and the pivotal movement is restrained by the pivot restraining portion 2*m*3.

When the buckle pretensioner completes the pulling of the buckle all the way back under such a state, a significantly large inertial force acts in the opposite direction, i.e. in the rightward direction, from that during the pulling back of the buckle 1. Thus, as shown in FIG. 6(*d*), the inertia lever member 12 is moved rightward and its pivot shafts 12*a* and 12*b* once again contact and are supported by the pivot shaft support 2*m*1. At this stage, the operation button 6 also moves rightward by the inertial force, and its inertia lever member parts 6*d* contact the urged portions 12*c* and 12*d* to press the urged portions 12*c* and 12*d* diagonally upward at its inclined surface. Then, by the inertia force of the operation button 6, a moment which urges the inertia lever member 12 to pivot clockwise is generated. Although, at the same time, a moment which urges the inertia lever member 12 counterclockwise is generated by the inertial force acting upon the center of gravity G of the mass bodies 12*g* and 12*h,* the inertia lever member 12 is restrained from pivoting and the levers 12*e* and 12*f* are restrained from slipping off the moving path of the lock pin 5 extending in the longitudinal direction when the buckle is pulled back all the way. This is because, as described above, the counterclockwise moment due to the inertia force of the mass bodies 12*g* and 12*h* is set to be greater than the clockwise moment due to the inertia force of the operation button 6. Consequently, even if the lock pin 5 is urged to move rightward, that is, to the unlock position by the inertial force at the time the buckle is pulled all the way back, the lock pin 5 is prevented from moving to the unlock position as the lock pin 5 abuts against the tips of the lever 12*e* and 12*f*. In this manner, disengagement of the tongue due to inertia resulting from the operation of the buckle pretensioner is prevented and the tongue 3 and the buckle 1 are maintained securely and tightly latched.

As is apparent from the description above, the buckle according to the present invention reliably leads the tip of the tongue to the guide portions to achieve a smooth insertion even when the tongue is inserted from the tongue insertion opening in a slanted manner relative to the longitudinal direction of the buckle. Especially when a vehicle occupant is seated and inserts the tongue into the buckle, the vehicle occupant is likely to insert the tongue in such a slanted manner. Therefore, the manipulation feeling for inserting the tongue can be effectively improved.

Especially, in case a part of the operation means overlaps parts of the guide portions, the tip of the tongue can be securely led to the guide portions by the two side walls of the operation means. Therefore, the manipulation feeling for inserting the tongue can be further effectively improved.

While the invention has been explained with reference to the specific embodiment of the invention, the explanation is illustrative, and the invention is limited only by the appended claims.

What is claimed is:

1. A buckle comprising:

a base having two side walls and a bottom between the two side walls, a cover for accommodating and supporting the base, and having a tongue insertion hole formed at one end side of the two side walls of the base, guide portions provided on each of the two side walls to protrude inwardly therefrom for leading a tongue to be inserted through the tongue insertion hole, said guide portions having lower surfaces disposed substantially parallel to the bottom of the base, and operation means for unlatching the tongue and the buckle and having two side walls located between the side walls of the base adjacent thereto, respectively, said side walls of the operation means, when the operation means is located at a forward end in the buckle, extending to middle portions of the guide portions to partly overlap in a longitudinal direction thereof, said side walls of the operation means leading a tip of the tongue to the guide portions smoothly without blocking even when the tongue is inserted from the tongue insertion hole at a maximum slant posture defined by the tongue insertion hole relative to the buckle.

2. A buckle according to claim 1, wherein said two side walls of the operation means project toward the bottom of the base beyond the lower surfaces of the guide portions.

3. A buckle according to claim 1, wherein said base includes a front edge, said guide portions extending rearwardly from the front edge.

4. A buckle according to claim 3, wherein said cover includes a front lower edge for forming the insertion hole disposed at a front side of the front edge of the base, said maximum slant posture being defined by the front lower edge of the tongue insertion hole.

* * * * *